US005329713A

United States Patent [19]

Lundell

[11] Patent Number: 5,329,713

[45] Date of Patent: Jul. 19, 1994

[54] LABEL WITH REMOVABLE PART

[75] Inventor: Peter Lundell, Oakland, N.J.

[73] Assignee: Menasha Corporation, Neenah, Wis.

[21] Appl. No.: 156,411

[22] Filed: Nov. 22, 1993

Related U.S. Application Data

[63] Continuation-in-part of Ser. No. 822,196, Jan. 17, 1992, abandoned, which is a continuation of Ser. No. 435,737, Nov. 13, 1989, abandoned.

[51] Int. Cl.[5] ..... G09F 3/10

[52] U.S. Cl. ..... 40/310; 40/638

[58] Field of Search ..... 40/306, 310, 312, 299, 40/630, 638; 283/70, 79, 81, 101, 105

[56] References Cited

U.S. PATENT DOCUMENTS

| | | | |
|---|---|---|---|
| 558,280 | 4/1896 | Hollander | 40/310 |
| 581,494 | 4/1897 | Schwab | 40/310 |
| 880,115 | 2/1908 | Ahrens | 40/310 |
| 2,082,320 | 6/1937 | Berman | 40/310 |
| 3,946,507 | 3/1976 | Fergg et al. | 40/638 |
| 4,188,427 | 2/1980 | Grass | 40/299 X |
| 4,323,608 | 4/1982 | Denny et al. | 40/306 |
| 4,549,750 | 10/1985 | Stone et al. | 283/79 |
| 4,901,457 | 2/1990 | Chandler | 40/306 |

*Primary Examiner*—Kenneth J. Dorner
*Assistant Examiner*—Joanne Silbermann
*Attorney, Agent, or Firm*—Charles E. Baxley

[57] ABSTRACT

A container label comprises a main portion bearing generic identification indicia, an adhesive or the like for permanently securing the main portion to a container, a secondary portion bearing specific identification indicia, and an integral but destructible connection web between the main portion and the secondary portion. The secondary portion is itself free of securing means so that the secondary portion can be separated from the main portion by destruction of the web.

4 Claims, 2 Drawing Sheets

LABEL WITH REMOVABLE PART

CROSS-REFERENCE

This application is continuation-in-part application with respect to copending application Ser. No. 822,196 filed Jan. 17, 1992, now abandoned, which in turn was a continuation application with respect to then copending application Ser. No. 435,737 that had been filed on Nov. 13, 1989 and is now abandoned.

FIELD OF THE INVENTION

The present invention relates a label. More particularly the invention concerns a label used to identify a carefully controlled commodity such as a prescription pharmaceutical product.

BACKGROUND OF THE INVENTION

Certain products such as prescription pharmaceuticals must be tracked very carefully from manufacturer to user. It is particularly critical in many cases to determine just who the end user is and to ensure that the container is not reused for another product or otherwise misused. It is also necessary to be able to locate pharmaceuticals in the event their recall becomes necessary.

In the particular case of a prescription pharmaceutical it is essential to determine at what point the product actually passes from the end of the distribution chain to the consumer. In this manner any misuse or theft of inventory prior to being dispensed can be controlled.

To date the standard means of doing this is by making a note of the container number or the like as a product passes along its distribution chain. When ultimately dispensed the container number is reported back and matched, for instance, with a prescription and/or user identification number. Such a procedure is relatively failure-prone in that any misidentification subverts the system, and it still remains possible to pass off an already dispensed container as a legitimate one.

It has been suggested to provide a container label to which in turn is applied a releasable patch that can be peeled off and affixed to an inventory record, thereby ensuring both that a proper identification number will be entered on the record by affixing the patch thereto and that the remaining label will be left without its number. Such a system is open, however, to misuse in that it is possible to switch a patch from one such container to another.

OBJECTS OF THE INVENTION

It is therefore an object of the present invention to provide an improved container inventorying system.

Another object of the present invention is provision of an improved container label which overcomes the above mentioned disadvantages, that is which positively identifies the container at least as regards one critical stage of its use and that allows the container to be marked irreversibly.

SUMMARY OF THE INVENTION

A container label according to the present invention comprises a main portion bearing generic identification indicia, means such as an adhesive for securing permanently the main portion to a container, a secondary portion bearing specific identification indicia, and an integral but destructible connection web between the main portion and the secondary portion. The secondary portion is itself free of securing means so that it can be separated conveniently from the main portion by destruction of the web.

The web can take the form of a weakened line in the label which is normally made of paper, or can be interrupted by a row or line of spaced perforations in the web interconnecting the main and secondary portions. In addition, according to this invention, the secondary portion extends to an edge of the label so that the distributor can readily tear off the secondary portion both for inventory control and to mark the container as having been transmitted.

DESCRIPTION OF THE DRAWINGS

The above mentioned and other additional objects, features, and advantages will become more readily apparent from a detailed description which follows hereafter, reference being made to accompany drawings in which.

SPECIFIC DESCRIPTION

Figure 1:
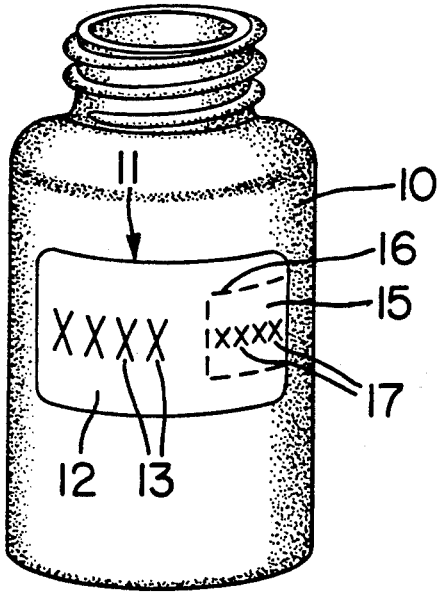
FIG. 1 is a perspective view of a container provided with a label according to the present invention.
Figure 2:
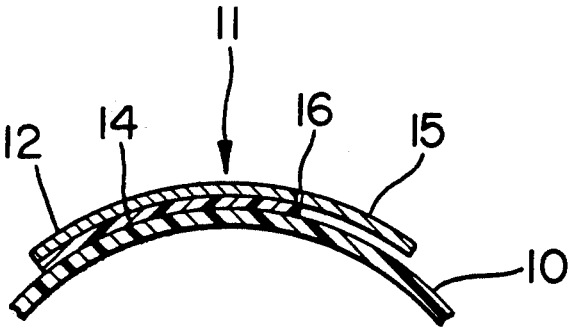
FIG. 2 is a fragmentary sectional view (exaggerated in scale for illustrative purposes) taken at right angles to the axis of the container and through the label.

As seen best in FIGS. 1 and 2, a container 10 according to the present invention is provided with a label 11 having a main generally U-shaped portion 12 bearing main indicia 13 and secured by an adhesive layer 14 to the container 10. The label 11 also is provided with a secondary portion 15 and the two portions 12 and 15 are separated by a U-shaped line 16 of perforations. The secondary portion 15 is itself not provided with any adhesive so that it is not connected to the container 10, and it carries secondary indicia 17. The container 10 is in the nature of a bottle of the type used for storage of prescription pharmaceuticals.

The secondary portion 15 extends to the edge of the label 11 so that when the container 10 is sold to a consumer, or anywhere else along its distribution chain, the secondary part 15 can easily be lifted up and stripped off, tearing it from the main portion 12 along the perforation 16. This tearing permanently and irreversibly changes the label 11, so that the container 10 cannot subsequently be restored.

Figure 4:
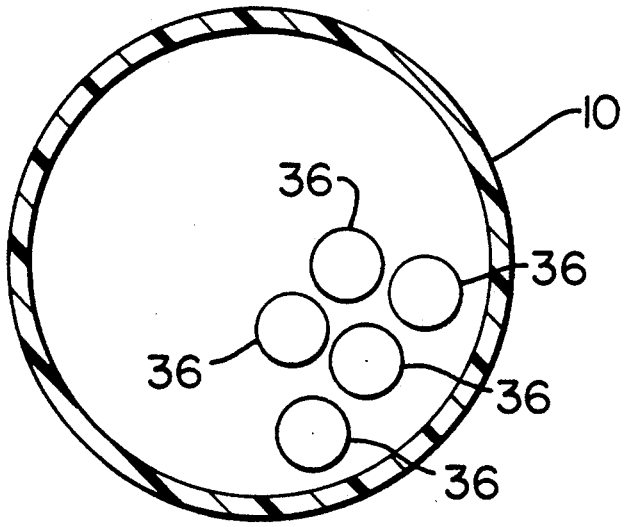
FIG. 4 is a sectional view taken at right angles to the axis of the container and below the label showing the contents of the container.

As a result of the tearing, once the secondary portion 15 has been removed, the distributor has proof that he or she has irreversibly marked the dispensed container 10. The portion 15 bearing the indicia 17 in turn can be used for inventory control. From FIG. 4 it will be seen that the container or bottle 10 contains a supply of a prescription pharmaceutical in the form of a pill or a tablet 36.

The label preferably is made of paper. Its thickness can be from 0,003 to 0.015 inches and preferably from 0.004 to 0,010 inches.

Figure 3:
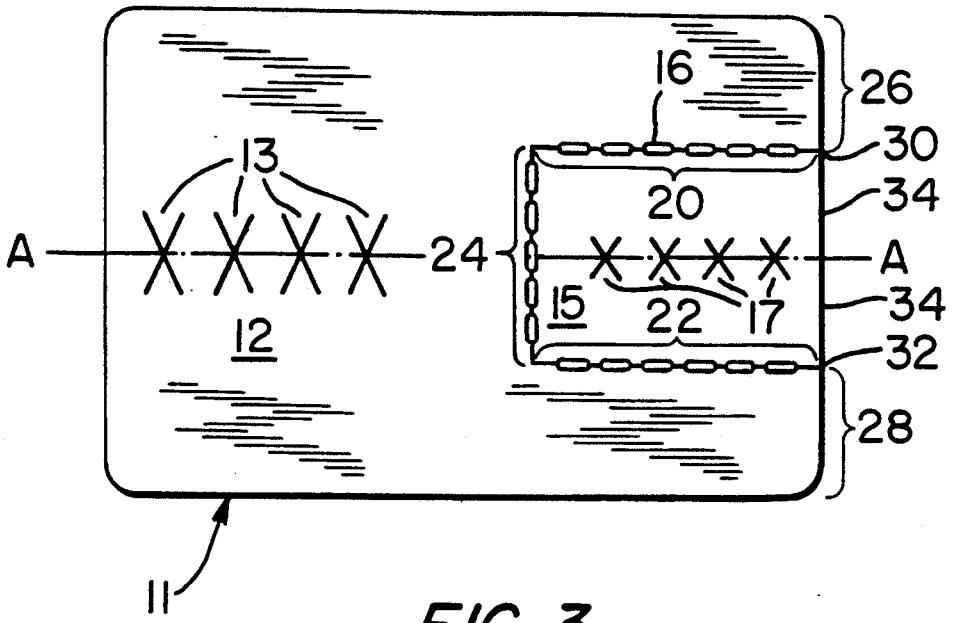
FIG. 3 is an enlarged elevational view of the label alone in a flat condition.

From FIG. 3 it will be seen that the label 11 is symmetrical with respect to a longitudinal centerline A—A which bisects the main portion 12 and the secondary portion 15. The label 11, as seen in FIG. 3, is unmodified, i.e., the secondary portion 15 is still attached in place. The label 11 presents a main outline that is partly defined by first and second lines 20 and 22 equispaced from and parallel to the centerline A—A, a third line 24 perpendicular to centerline A—A and terminating and joining the first and second lines 20 and 22 and by fourth and fifth lines 26 and 28 perpendicular to centerline A—A and terminating and joining the first and second lines 20 and 22, respectively, at ends thereof remote from the third line 24. Fourth and fifth lines 26 and 28 have inner ends 30 and 32, respectively, which are equispaced spaced from the centerline A—A. A connection web 16 disengageably joins the main portion 12 and the secondary portion 15 along the first line 20, the second line 22 and the third line 24. The secondary portion 15 has an exposed part 34 extending between the inner ends 30 and 32 of the fourth and fifth lines 26 and 28.

It will be understood by those familiar with packaging and inventory control that wide deviations may be made from the foregoing embodiment without departing from a main theme of invention set forth in claims which follow hereafter.

I claim:

1. A combination of a bottle with an outer surface, a supply of a prescription pharmaceutical within said bottle and dispensable therefrom, and an initial unmodified label of negligible thickness and having an overall outline of a first characteristic shape, said unmodified label including a single contiguous main portion engaging and permanently adhered to said outer surface of said bottle and bearing indicia exposed to view and having a main outline of a second characteristic shape and providing a main part but less than all of said overall outline, a single contiguous secondary portion confronting but not adhered to said outer bottle surface and bearing indicia exposed to view and having a secondary outline providing a part but less than all of said overall outline, said main and secondary portions together providing the entirety of said overall outline, and an integral destructible connection web between and joining said main portion and said secondary portion, whereby said secondary portion can be separated from said main portion and removed from said bottle upon destruction of said web, to convert said initial unmodified label to a final modified label consisting of said main portion, thus changing the shape of the label from said first characteristic shape to said second characteristic shape, to provide visible indication that said secondary portion has been removed.

2. The combination defined in claim 1 wherein said web is interrupted by a linear series of perforations.

3. The combination defined in claim 1 wherein the perimeter of said overall outline is less than the perimeter of said main outline.

4. The combination defined in claim 3 wherein said initial unmodified label is symmetrical with respect to a longitudinal centerline that bisects said main portion and said secondary portion.

* * * * *